US005779894A

United States Patent [19]

Martensson

[11] Patent Number: 5,779,894

[45] Date of Patent: Jul. 14, 1998

[54] ASEPTIC BAG FOR SEPARATING OFF LIQUID

[75] Inventor: Karl Martensson, deceased, late of Lund, Sweden, by Ulla Thulin, executor

[73] Assignee: Tetra Laval Holdings & Finance S.A., Pully, Switzerland

[21] Appl. No.: 760,309

[22] Filed: Dec. 4, 1996

[30] Foreign Application Priority Data

Dec. 6, 1995 [DK] Denmark ..... 1382/95

[51] Int. Cl.[6] ..... B65D 30/26; B65D 33/01; B65D 81/26; B65D 81/30

[52] U.S. Cl. ..... 210/232; 210/474; 426/79; 426/112; 426/115; 383/41; 383/66; 383/101; 383/102; 383/103; 383/109; 383/38

[58] Field of Search ..... 210/474, 542, 210/232; 426/79, 112, 115; 383/41, 66, 101, 102, 38, 109, 103

[56] References Cited

U.S. PATENT DOCUMENTS

| | | |
|---|---|---|
| 2,794,553 | 6/1957 | Colarusso . |
| 3,190,441 | 6/1965 | Rausing . |
| 3,223,619 | 12/1965 | Calmon . |
| 3,224,586 | 12/1965 | Wade . |
| 3,738,080 | 6/1973 | Reil . |
| 3,744,639 | 7/1973 | Teeple . |
| 3,884,012 | 5/1975 | Ernstsson et al. . |
| 3,970,426 | 7/1976 | Stark et al. . |
| 4,243,260 | 1/1981 | Reil . |
| 4,319,517 | 3/1982 | McCaleb . |
| 4,367,842 | 1/1983 | Rausing . |
| 4,443,336 | 4/1984 | Bennethum . |
| 4,629,064 | 12/1986 | Barner . |
| 4,683,702 | 8/1987 | Vis . |
| 4,731,978 | 3/1988 | Martensson . |
| 4,776,367 | 10/1988 | Hilmersson et al. . |
| 4,797,010 | 1/1989 | Coelho . |
| 4,861,632 | 8/1989 | Caggiano . |
| 4,984,907 | 1/1991 | Power . |
| 5,346,312 | 9/1994 | Mabry . |
| 5,469,880 | 11/1995 | Zimmerly . |

FOREIGN PATENT DOCUMENTS

| | | |
|---|---|---|
| 458521 | 4/1989 | Sweden . |

*Primary Examiner*—Thomas M. Lithgow
*Attorney, Agent, or Firm*—Burns, Doane, Swecker & Mathis, L.L.P.

[57] ABSTRACT

The disclosure relates to an aseptic bag (1) for separating off liquid. The bag comprises a tight outer bag (2) and a perforated inner bag (3). Each bag (2, 3) consists of two parts (4, 5, 6, 7). In the first bag part (4, 6) of the outer bag (2) and the inner bag (3), there is disposed an inlet device (12) and, in the second bag part (5, 7), there are disposed closure means (13) which may rigidly engage with the inlet device (12). In addition, there is provided in the first part (4) of the outer bag (2) an outlet device (18) and corresponding closure means (19) in its second part (5). An inlet valve (14) is connected to the inlet device (12) and an outlet valve (22) is connected to the outlet device (18). The product, solid particles mixed with a carrier liquid, is filled through the inlet valve (14) into the aseptic bag (1). The solid particles will then remain in the inner bag (3), while the liquid will continue through the perforations in the bag (3) and be separated through the outlet valve (22).

6 Claims, 3 Drawing Sheets

ASEPTIC BAG FOR SEPARATING OFF LIQUID

TECHNICAL FIELD

The present invention relates to an aseptic bag for separating off liquid, and comprising an outer bag and an inner bag, an inlet device and means for closing the inlet device, and an outlet device and means for closing the outlet device.

BACKGROUND ART

In finished food products such as soups, sauces, pizza toppings, fruit salads and the like, there is often a wish in the art to add solid particles such as diced carrot, peas, diced tomatoes, pineapple chunks or the like in order to improve the quality of the finished product. Most generally, such solid particles are produced and processed separately from the rest of the finished food product. In order to be able to process the solid particles in an efficient and gentle manner, these must be mixed with a low viscosity carrier liquid, normally water. The carrier liquid keeps the particles suspended throughout the entire processing time, and it also simultaneously transfers heat, for example in heat treatment in heat exchangers and the like. The quantity of water in relation to solid particles depends upon the constitution of the solid particles themselves. This carrier liquid, the water, generally has no commercial or quality value, for which reason it is desirable to separate the liquid off before the particles are stored or transported. Given that the proportion of particles in relation to liquid may be up to 50:50, it would involve a major cost to include this liquid during transport or storage. In order to treat the solid particles gently, this separation should, however, be put into effect as late as possible before storage and transport, at the same time as the process must be satisfactory from the aseptic viewpoint.

Swedish Patent Specification SE 448 444 describes a closable bag which makes for the aseptic filling and storage of, for example, foods. This bag, which is in two parts joined together to one another in sterile fashion, displays an inlet device disposed in the first part of the bag, and closure means for closing the inlet aperture in the second part of the bag. By sterilizing the opening and closure means before the bag is filled, an aseptic storage and transport bag for foods will be obtained.

OBJECTS OF THE INVENTION

One object of the present invention is, by providing such a bag with an arrangement according to the present invention, to realize an apparatus for separating the carrier liquid which it is not desirable to store or transport together with the solid particles which are to be used for producing a finished food product.

A further object of the present invention is to realize separation of water which takes place as late as possible so as not to damage the solid particles by unnecessary handling.

SOLUTION

These and other objects have been attained according to the present invention in that the aseptic bag of the type described by way of introduction has been given the characterizing features that the inner bag is perforated, and that the inlet device is disposed in the first part of the outer and inner bags, that the closure means of the inlet device are disposed in the second part of the inner and outer bags, and that the outlet device is disposed in the first part of the outer bag and the means for closing the outlet device are disposed in the second part of the outer bag.

Preferred embodiments of the present invention have further been given the characterizing features as set forth in the appended subclaims.

BRIEF DESCRIPTION OF THE ACCOMPANYING DRAWINGS

One preferred embodiment of the present invention will now be described in greater detail hereinbelow, with particular reference to the accompanying Drawings, in which.

DESCRIPTION OF PREFERRED EMBODIMENT

Figure 1:
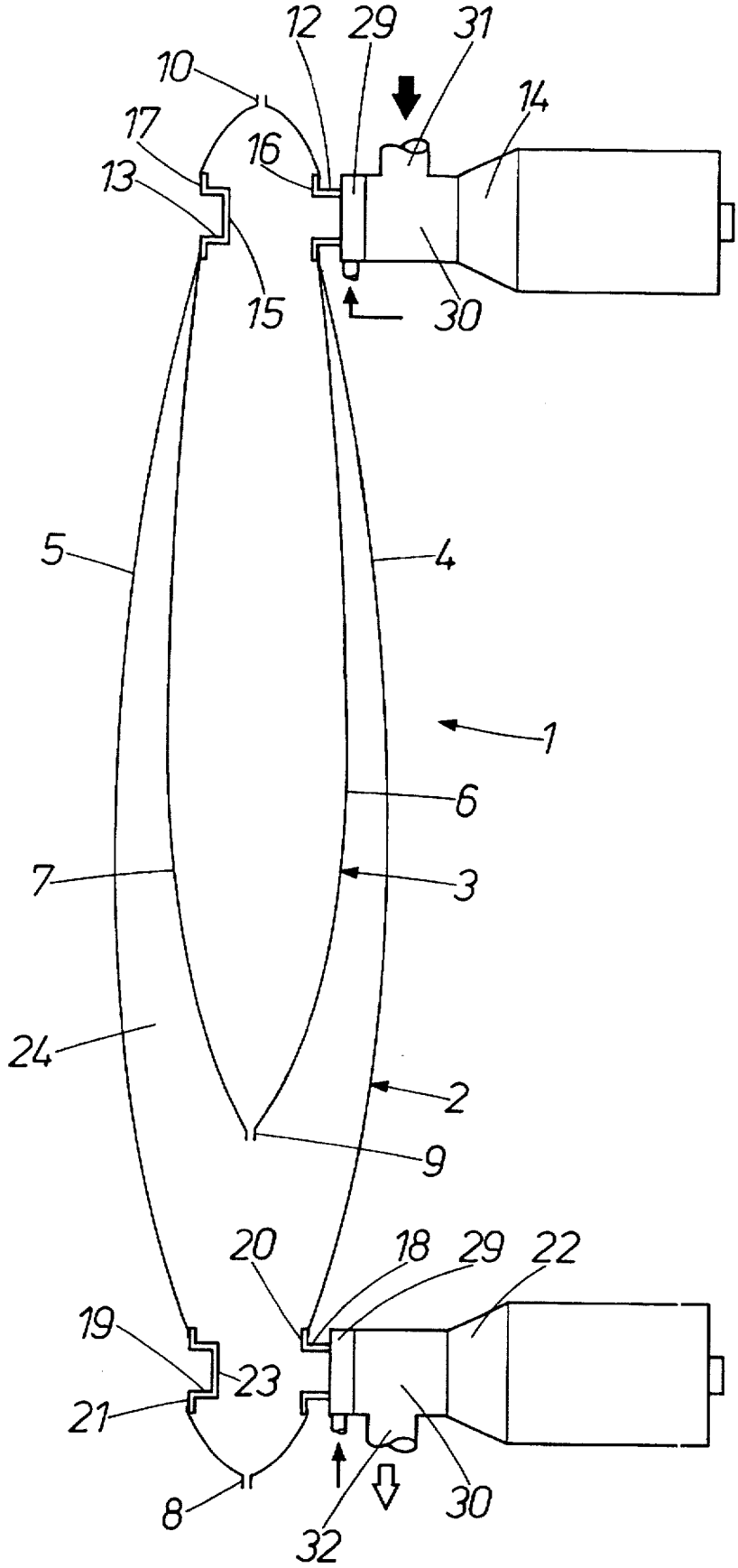
FIG. 1 is a side elevation, partly in section, of a bag according to the present invention.

As shown in the accompanying Drawings, the aseptic bag 1 according to the present invention consists of an outer bag 2 and an inner bag 3. Each bag consists of a first part 4, 6 and 5, 7, respectively. The different parts 4, 5, 6 and 7 are joined together by, for instance, heat sealing along sealing zones 8, 9 so that the parts 4 and 5 constitute the outer bag 2, defined by the sealing zone 8, and the parts 6 and 7 constitute the inner bag 3, defined by the sealing zone 9. The sealing zones 8 and 9 have one side 10 which is wholly or partly common to both of the bags 2, 3.

The bags 2 and 3 are preferably manufactured from a heat-sealable material, for example polyethylene. In addition, the outer bag 2 has a layer laminated to its surface which is to serve as a barrier layer against light and oxygen gas. This layer may consist of, for example, aluminum foil (Alifoil), metallised polyester or an ethylene vinyl alcohol copolymer (EVOH), depending upon what product the barrier layer is to protect. The outer bag is completely tight in relation to its ambient surroundings. The inner bag 3 need not be provided with such a barrier layer, since it is wholly enclosed inside the outer bag 2. However, the surface of the inner bag 3 displays a perforation pattern for allowing the passage of the liquid which is to be separated off in the aseptic bag 1.

The perforation pattern may wholly or partly cover both parts 6 and 7 of the inner bag 3. The pattern of the perforations and the mesh size of the perforation holes 11 depend upon the size of the solid particles it is intended to separate from the liquid. The larger the perforation holes 11 and the denser the perforation pattern, the quicker will be separation of the liquid, at the same time as all particles are retained in the inner bag 3. The mesh size of the perforation holes 11 and the density of the perforation pattern must not jeopardise the mechanical strength of the inner bag 3 and its capability to support the solid particles. Moreover, the perforation holes 11 should be made with rounded edges, i.e. round or oval perforation holes 11, so as to avoid unnecessary indications of weakness or rupture at the edges of the holes.

The aseptic bag 1 according to the present invention further includes an inlet device 12 and closure means 13 for the inlet device 12. The inlet device 12 is intended to be connected to a replenishment device which may consist of an inlet valve 14. In FIG. 1, the inlet device 12 is shown in the open state. In the closed state, the closure means 13 engage rigidly in the inlet device 12 so that the end wall 15 of the closure means 13 shuts off the inlet device from the ambient surroundings. The inlet device 12 is disposed in the first part 4, 6 of the outer bag 2 and inner bag 3, and the closure means 13 for the inlet device 12 are disposed in the second part 5, 7 of the outer bag 2 and the inner bag 3, respectively. Both the inlet device 12 and the closure means 13 are provided with flanges 16, 17 which are heat-sealed to the bag parts 4, 5, 6 and 7. The parts 6 and 7 of the inner bag 3 are suitably provided with discontinuations in the perforation pattern where the flanges 16, 17 are sealed to the parts 6, 7 so that the seals obtain maximum strength and tightness.

Figure 3:
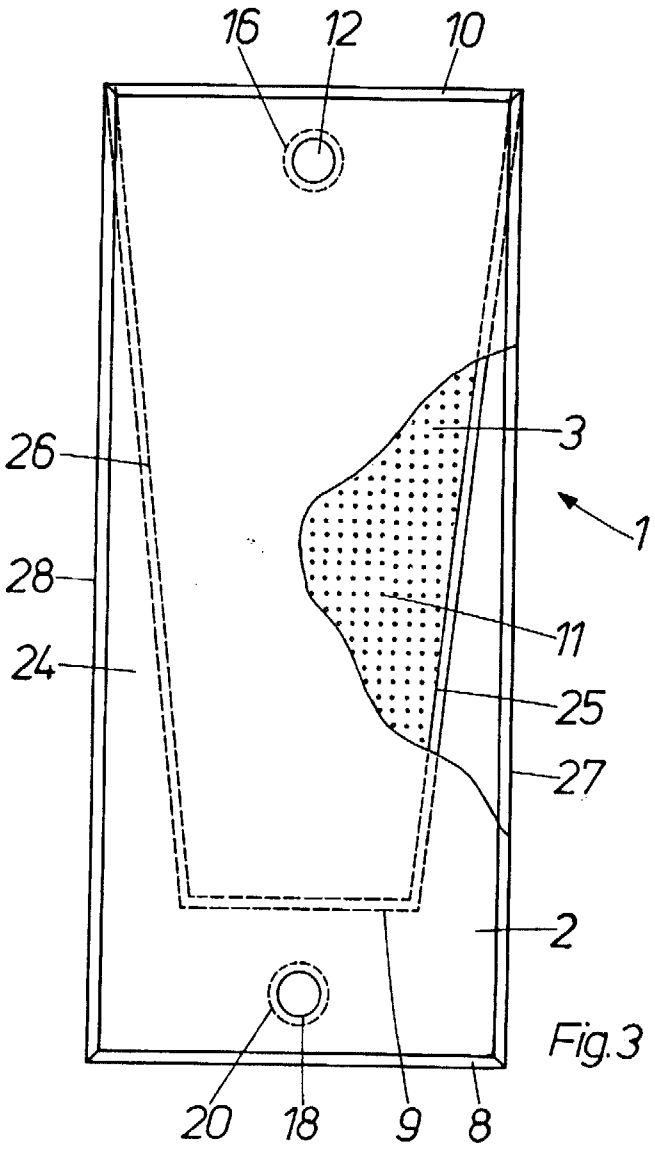
FIG. 3 is a top plan view of an alternative embodiment of the present invention.
Figure 2:
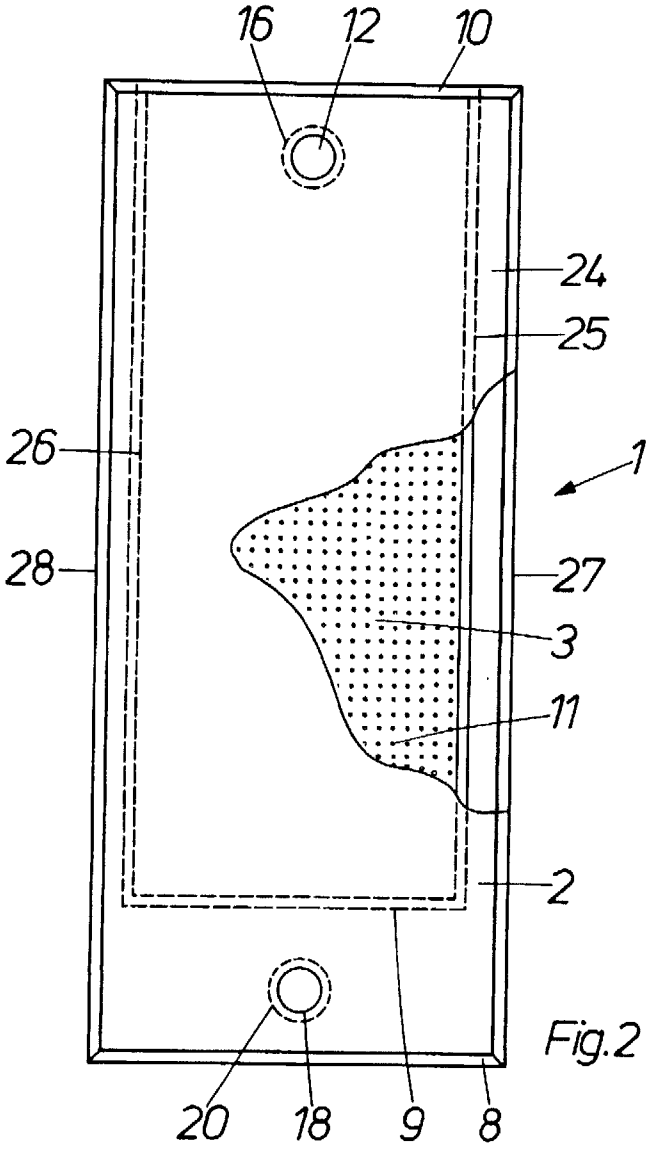
FIG. 2 is a top plan view of a bag according to the present invention.

The side 10 of the sealing zone 8, 9 which is common to both of the bags 2 and 3 is placed most proximal the inlet device 12 and the closure means 13 and is oriented such that the common side 10 will constitute the upper defining surface of the aseptic bag 1. The inner perforated bag 3 will, with this orientation, be shorter than the outer unperforated bag 2, as shown in FIGS. 1–3.

In the lower region of the outer bag 2, there is disposed an outlet device 18 with closure means 19 for the outlet device 18, so that the outlet device 18 is fixed by heat-sealing in the flange 20 to the first part 4 of the outer bag 2 and so that the closure means are secured in a similar fashion with the flange 21 to the second part 5 of the outer bag 2. The outlet device 18 is intended to be connected to a discharge arrangement which may consist of an outlet valve 22.

FIG. 1 also shows the outlet device 18 in the open state, and, in the closed state the closure means 19 of the outlet device 18 rigidly engage in the outlet device 18 so that the end wall 23 of the closure means 19 shuts off the outlet device 18 from the ambient surroundings.

The extent of the inner perforated bag 3 within the outer bag 2 should be as large as possible in order to realize a good storage capacity in the inner bag 3. The extent of the inner bag 3 should not, however, be greater than, on use of the bag 1, a space 24 is created between the inner bag 3 and the outer bag 2. FIGS. 2 and 3 show alternative variations of extent for the inner bag 3. In FIG. 2, the two bags 2 and 3 have only partly a common sealing side 10 and the other edges 25, 26 of the inner bag 3 are substantially parallel with the other edges 27, 28 of the outer bag 2. In FIG. 3, both of the bags 2 and 3 share an entirely common sealing side 10 while the two adjacent edges 25, 26 of the inner bag 3 are not parallel with corresponding edges 27, 28 of the outer bag 2. There is hereby created the necessary space 24 between the inner bag 3 and the outer bag 2 for the completely satisfactory function of the aseptic bag 1.

When the aseptic bag 1 according to the present invention, as shown in FIG. 1, is put into use, an inlet valve 14 and an outlet valve 22 are connected respectively to the inlet device 12 and the outlet device 18. These valves 14, 22 should be aseptic for both aseptic filling and emptying of the bag 1. Such valve is described in detail in Swedish Patent Specification SE 458 521. Each valve 14, 22 has a minor space 29 to which steam can be connected for sterilizing the space 29, at the same time as sterilization of end wall 15,23 takes place. The valves 14,22 moreover each display a housing 30 with an inlet connection 31 and outlet connection 32, respectively.

FIGS. 4 A–D show the principle of the cycle of sterilization, filling and reclosure of an aseptic bag 1 according to the present invention. FIG. 4A shows a closed bag 1 to whose inlet device 12 there is connected an inlet valve 14. Operating equipment 33 is connected to the closure means 13 of the bag 1. The operating equipment 33 and the inlet valve 14 at the same time make it possible to suspend the bag 1 such that it hangs freely prior to the filling operation. Steam is passed through the steam duct 34 in the inlet valve 14, such that the space 29 and the end wall 15 of the closure means 13 are sterilized.

Figure 4B:
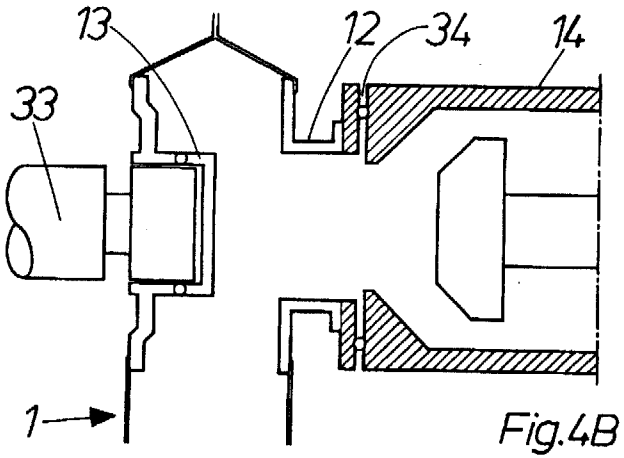
FIGS. 4 A–D show the principle of a closable bag.
Figure 4D:
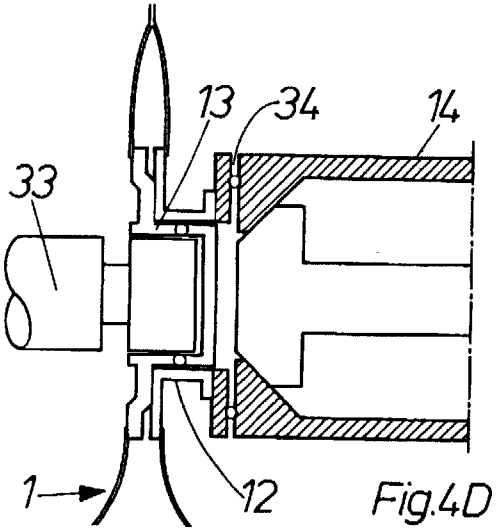
Figure 4A:
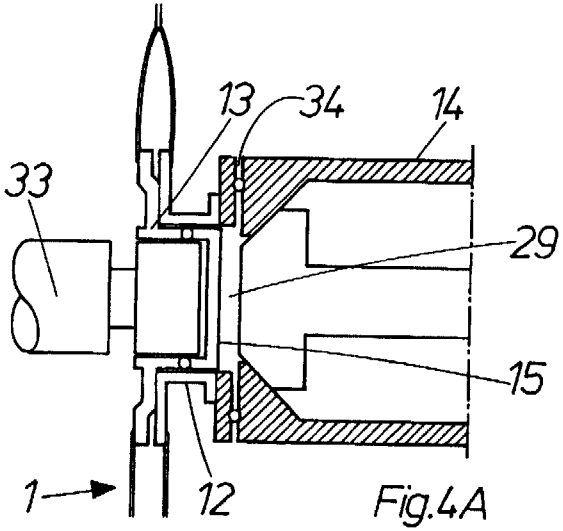
Figure 4C:
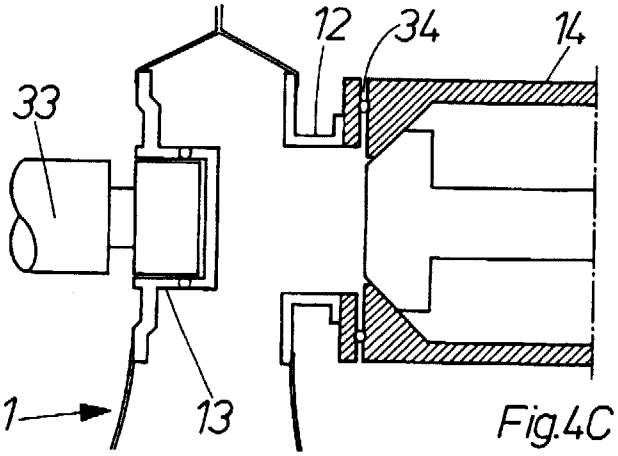

The operating equipment 33 thereafter pulls apart the closure means 13 from the inlet device 12 so that the bag 1 is opened (see FIG. 4B). The inlet valve 14 opens and the product may be aseptically filled into the bag 1. When the filling of the bag 1 is completed, the inlet valve 14 recloses (FIG. 4C) and once again permits the passage of steam through the steam duct 34 so that the space above the product is cleaned before reclosure of the aseptic bag 1. Reclosure of the bag 1 as shown in FIG. 4D takes place in that the closure means 13 are moved by means of the operating equipment 33 back into engagement with the inlet device 12. The inlet valve 14 may thereafter be removed from the inlet device 12 and the filled bag 1 is ready for transport or storage.

The product which is intended for the bag 1 and which may consist, for example, of diced vegetables, peas or pieces of fruit mixed with a carrier liquid (which normally consists of water) is fed into the bag 1 through the inlet connection 31 and via the inlet valve 14 and inlet device 12 into the inner bag 3. The solid particles are entrapped in the inner bag 3, while the carrier liquid continues out through the perforation holes 11, into the space 24 and is enclosed by the outer bag 2. By having an open outlet conduit 32 at the outlet device 18 and the outlet valve 22, it is possible to allow the liquid to run to waste, or alternatively if the liquid contains aroma substances or other qualities which may prove to be useful, the liquid (which is still sterile) may be pumped further for other use. Yet a further alternative for saving the liquid is to keep the outlet device 18 closed and form the outer bag 2 to be of such length that it can accommodate the separated liquid, whereafter a heat-seal is applied transversely over the outer bag 2 so that the liquid is enclosed in a separate space of the outer bag 2. The sealed-off space may then be separated from the rest of the bag 1 and the liquid be used for other purposes.

Trials have shown that 100 per cent of the carrier liquid is separated within a few seconds and there then remains in the inner bag 3 the ready-processed, solid particles which can be stored or transported under satisfactorily aseptic conditions until the particles are to be used in a finished food product. Given that the aseptic bag 1 is intended to be of the single-use disposable type the bag 1 may be cut open to allow access to the particles, or alternatively the contents may be removed through the opening of the inlet device 12.

As will have been apparent from the foregoing description, the present invention realizes a closable, aseptic bag in which it is possible to separate carrier liquid from solid particles at as late a stage as possible, i.e. in the bag 1 proper, whereby a gentle but nevertheless efficient separation is achieved. The dewatered particles will further be directly packed in an aseptic storage or transport bag 1 without the need to handle the carrier liquid any further.

The present invention should not be considered as restricted to that described above and shown on the Drawings, many modifications being conceivable without departing from the spirit and scope of the appended claims.

What is claimed is:

1. An aseptic bag for separating off liquid comprising an outer bag and an inner bag, an inlet device and means for closing said inlet device, and an outlet device and means for closing said outlet device, wherein the inner bag is perforated, the inlet device is disposed in a first part of the outer bag and in a first part of the inner bag, said closure means of said inlet device is disposed in a second part of the outer bag and in a second part of the inner bag, the outlet device is disposed in the first part of the outer bag, and said means for closing the outlet device is disposed in the second part of the outer bag.

2. The aseptic bag as claimed in claim 1, wherein said first part and said second part of the outer bag are joined together in an outer sealing zone, said first part and said second parts of the inner bag are joined together in an inner sealing zone, and one side of the outer and inner sealing zones is at least partly common to both.

3. The aseptic bag as claimed in claim 2, wherein said one side of the outer and inner sealing zones is only partly in common to both, and adjacent edges of the inner bag are substantially parallel with corresponding edges of the outer bag.

4. The aseptic bag as claimed in claim 2, wherein said one side of the outer and inner sealing zones is wholly in common to both and adjacent edges of the inner bag are not parallel with corresponding edges of the outer bag.

5. The aseptic bag as claimed in claim 1, wherein the outer bag is manufactured from polyethylene and has a barrier layer of aluminum foil, and the inner bag is manufactured from polyethylene.

6. The aseptic bag as claimed in claim 1, wherein the inlet device is disposed to be connected to an inlet valve for the inlet of solid particles mixed with carrier liquid, and the outlet device is disposed to be connected to an outlet valve for the outlet of the carrier liquid.

* * * * *